US008622142B2

(12) United States Patent
Shaw

(10) Patent No.: US 8,622,142 B2
(45) Date of Patent: Jan. 7, 2014

(54) SEALING WELLHEAD MEMBERS WITH BI-METALLIC ANNULAR SEAL

(75) Inventor: Michael Shaw, Aberdeenshire (GB)

(73) Assignee: Vetco Gray Inc., Houston, TX (US)

( * ) Notice: Subject to any disclaimer, the term of this patent is extended or adjusted under 35 U.S.C. 154(b) by 442 days.

(21) Appl. No.: 12/695,037

(22) Filed: Jan. 27, 2010

(65) Prior Publication Data

US 2011/0180275 A1 Jul. 28, 2011

(51) Int. Cl.
*E21B 33/03* (2006.01)

(52) U.S. Cl.
USPC ..... 166/379; 166/368; 277/647

(58) Field of Classification Search
USPC ..... 166/368, 379; 277/564, 567, 647, 438, 277/439, 530; 285/99
See application file for complete search history.

(56) References Cited

U.S. PATENT DOCUMENTS 3,285,615 A 11/1966 Trbovich
4,103,909 A * 8/1978 Hoffman et al. ..... 277/520
4,178,000 A * 12/1979 Kuttner ..... 277/468
4,178,020 A * 12/1979 Dopyera ..... 285/18
4,353,560 A * 10/1982 Tohill ..... 277/328
4,592,558 A * 6/1986 Hopkins ..... 277/572
4,595,053 A 6/1986 Watkins
4,706,970 A * 11/1987 Ramirez ..... 277/556
4,900,041 A * 2/1990 Hopkins et al. ..... 277/328
5,044,672 A * 9/1991 Skeels et al. ..... 285/98
5,076,594 A 12/1991 Baugh
5,201,835 A 4/1993 Hosie
5,224,715 A 7/1993 Downes et al.
5,720,503 A 2/1998 Drijver et al.
5,860,680 A 1/1999 Drijver et al.
6,007,070 A * 12/1999 Heathcott et al. ..... 277/510
6,164,663 A 12/2000 Turner
6,926,283 B2 * 8/2005 Janoff et al. ..... 277/603
7,559,366 B2 * 7/2009 Hunter et al. ..... 166/217

* cited by examiner

*Primary Examiner* — William P Neuder
*Assistant Examiner* — Robert E Fuller
(74) *Attorney, Agent, or Firm* — Bracewell & Giuliani LLP

(57) ABSTRACT

A wellhead seal assembly that forms a metal-to-metal seal between inner and outer wellhead members. A bi-metallic U-shaped seal with legs having a low yield metal on the outer portions. During installation of the seal assembly, the legs of the seal are forced outward against the surfaces of the wellhead members, by pressurization of a interim non-metallic seal which forces a wedge into the U-shaped seal, causing localized yielding of the low yield metal to fill defects on wellhead member surfaces.

18 Claims, 2 Drawing Sheets

SEALING WELLHEAD MEMBERS WITH BI-METALLIC ANNULAR SEAL

FIELD OF THE INVENTION

This invention relates in general to wellhead assemblies and in particular to a seal for sealing between inner and outer wellhead members.

BACKGROUND OF THE INVENTION

Seals are used between inner and outer wellhead tubular members to contain internal well pressure. The inner wellhead member may be a casing hanger located in a wellhead housing and that supports a string of casing extending into the well. A seal or packoff seals between the casing hanger and the wellhead housing. The casing hanger could also be the outer wellhead member, with an isolation sleeve as the inner wellhead member. Alternatively, the inner wellhead member could be a tubing hanger that supports a string of tubing extending into the well for the flow of production fluid. The tubing hanger lands in an outer wellhead member, which may be a wellhead housing, a Christmas tree, or a tubing head. A packoff or seal seals between the tubing hanger and the outer wellhead member.

A variety of seals of this nature have been employed in the prior art. Prior art seals include elastomeric and partially metal and elastomeric rings. Prior art seal rings made entirely or partially of metal for forming metal-to-metal seals are also employed. The seals may be set by a running tool, or they may be set in response to the weight of the string of casing or tubing.

If the bore or surface of the outer wellhead member is damaged, a seal would struggle to maintain a seal. The elastomeric portion can provide additional robustness to the seal to help maintain a seal. In addition, a softer metal on the outer surface of a seal can also be used to fill scratches and surface imperfections on the surfaces of the wellhead members.

A need exists for a technique that addresses the seal leakage as described above. The following technique may solve these problems.

SUMMARY OF THE INVENTION

In an embodiment of the present technique, a bi-metallic seal assembly for use in subsea oil and gas applications is provided that comprises a metallic U-shaped seal that forms a metal-to-metal seal and has features that increase the reliability of the seal assembly in the event surface degradation or defects in a bore of a wellhead member increases the difficulty of maintaining a seal. The seal assembly also has a softer, lower yield metal at regions on the seal assembly where sealing occurs. The U-shaped seal incorporates tapered faces on its internal slot or pocket and is set (conditioned to seal at low pressure) by a test pressure applied to the seal assembly via an interim or bulk seal coupled to a wedge element that drives the legs of the U-shaped seal apart. The softer, low yield metal on the outer portions of the legs is forced against the surfaces of the wellhead members, causing localized yielding of the low yield metal to fill defects on wellhead member surfaces.

The bulk seal is on the primary pressure side and the taper of the legs is acute enough to prevent friction lock to allow seal retrieval. The wedge may be vented to allow fluid to flow as the wedge is forced into the seal pocket and thus avoid hydraulic lock. An additional compressible element may be fitted into the pocket of the U-shaped seal to avoid hydraulic lock. The compressible element could either be in the pocket or in the annulus formed between the interim seal and the metal seal. Axial loads required to push the seal assembly into its annular space between the wellhead members are minimal as only a small amount of radial squeeze, i.e. interference fit, is needed to maintain a sealing contact at low pressure. This also ensures that if the wedging mechanism fails, a seal can be obtained at least on surfaces without defects. Further, two U-shaped seals may be mounted back to back to allow sealing in two directions.

The seal assembly is preferably pre-assembled onto an inner wellhead member, such as an isolation sleeve or tubing hanger. The inner wellhead member and seal assembly may then be lowered into an outer wellhead member, such as a wellhead housing, in the same run and the seal set by applying pressure to the bulk seal.

In the event of bulk seal failure, the U-shaped seal is self-energizing and when pressurized is capable of sealing and filling against damaged annular surfaces of wellhead members. The pocket formed by the legs of each of the U-shaped seals may allow well pressure to act on the inner side of the legs, pushing the legs outward against the outer and inner wellhead members.

The seal assembly can rest on a shoulder formed on the wellhead housing and can be set by pressurizing the annular space between the outer and inner wellhead members to push the seal assembly into place. The combination of the lower yield metal on the exterior of the seal legs, as well as the bulk seal coupled to the wedge, improves sealing in wellhead members having surface degradations.

DETAILED DESCRIPTION OF THE INVENTION

Figure 1:
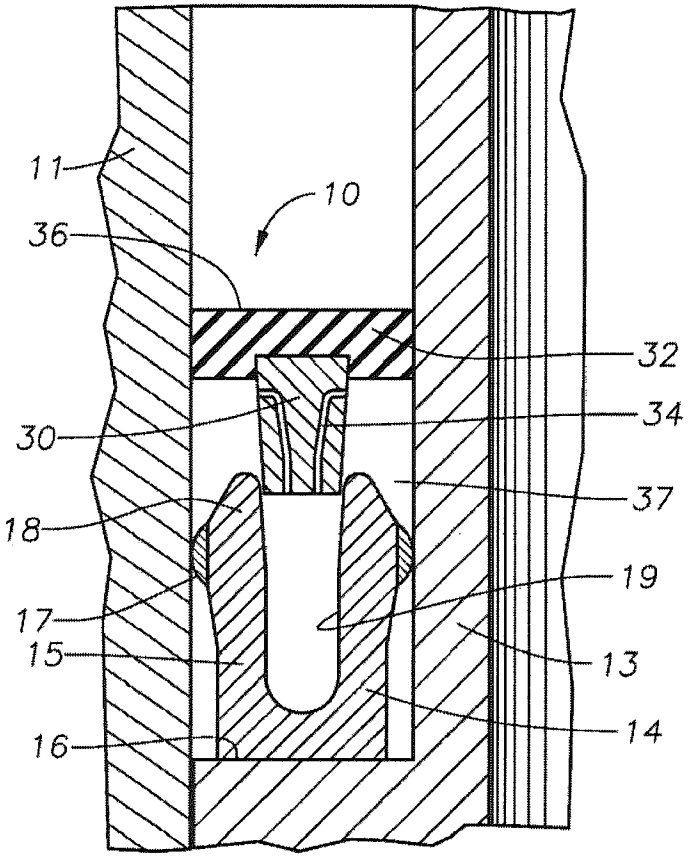
FIG. 1 is a sectional view of a seal assembly in the unset position, in accordance with an embodiment of the invention.

Referring to FIG. 1, an embodiment of the invention shows a seal assembly 10 located between a portion of an inner wellhead member that may comprise an isolation sleeve or a tubing hanger 13 having an outer profile and an outer wellhead member that may comprise a wellhead housing, treehead, or casing hanger 11. The isolation sleeve or tubing hanger 13 has a radially extending shoulder 16. The shoulder 16 supports the seal assembly 10 in this embodiment and provides a reaction point during setting operations. Alternatively, the inner wellhead member 13 could instead be a plug, safety valve, or other device, and outer wellhead member 11 could be a tubing spool or a Christmas tree. The annular seal assembly 10 can be fitted to the isolation sleeve or tubing hanger 13 via interference with their outer profile and is pre-assembled onto the isolation sleeve or tubing hanger 13 prior to installation at the well. The seal assembly 10 and tubing hanger 13 can be run into the bore of the housing 11 as one in a single trip with a conventional running tool. If the inner wellhead member is an isolation sleeve, the isolation sleeve 13 can be lowered into place in a tree.

The seal assembly 10 is shown in the unset position and comprises a U-shaped metal seal 14 having legs 15 that form a U-shaped slot 19. In this embodiment, the metal seals 14 may be bi-metallic, with the body formed out of a higher yield strength metal and a lower yield metal seal bands 17 forming the areas of sealing contact, such as the tips 18 of the legs 15.

Continuing to refer to FIG. 1, an annular energizing ring 30 is coupled to an interim or bulk seal 32 at its wider end. The energizing ring 30 is initially in a run-in position. The energizing ring 30 may have tapered or conical inner and outer surfaces. During setting, a setting pressure is applied to the seal assembly 10 via an exposed surface 36 of the bulk seal 32 in order to push energizing ring 30 downward between the legs 15 of the U-shaped seal 14. Energizing ring 30 creates a radial inward and outward force on seal bands 17. In this embodiment, the bulk seal 32 is on the primary pressure side. The inner surfaces of the legs 15 of the seal 14 and the outer surfaces of energizing ring 30 have a mating taper that is acute enough to prevent energizing ring 30 from locking in slot 19. The acute taper angle allows retrieval of the seal 10. A sealed cavity 37 is defined by the bulk seal 32 and the seal bands 17 of the seal 14. Energizing ring 30 may have vents 34 that traverse the body of the wedge 30 to allow fluid to flow from cavity 37 through it as the wedge 34 is forced into the seal slot 19. This prevents hydraulic lock from occurring within the pocket 19 and the sealed cavity 37 and thus allows wedge 30 to travel to thereby set the seal 14. A compressible element 38 (FIGS. 3 and 4) may also be located within pocket 19 to further aid in the prevention of hydraulic lock within the pocket 19 and cavity 37. In addition to the sealing provided by bulk seal 32, bulk seal 32 may also perform a wiping function for the metal seal 14 when energized.

Figure 2:
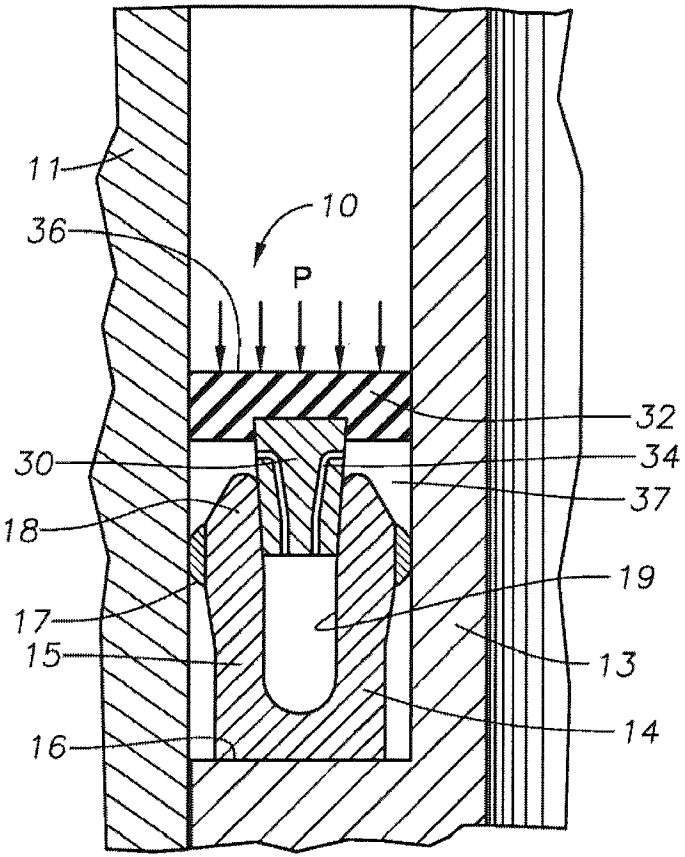
FIG. 2 is a sectional view of the seal assembly of FIG. 1 in the set position, in accordance with an embodiment of the invention.

Referring to FIG. 2, the seal assembly 10 is shown in the set position. During setting operations, for example, the annulus between the outer wellhead member 11 and the inner wellhead member 13 may be pressurized. As explained above, the outer wellhead member 11 may be a casing hanger and the inner wellhead member 13 may be a tubing hanger. The applied force from the pressure acts on the exposed surface 36 of the bulk seal 32, is transmitted through the energizing ring 30 to the seal 14, and reacts against the shoulder 16 on the tubing hanger 13 to force the energizing ring 30 into seal slot 19. Metal bands 17 on the outer portions of the legs 15 touch the surfaces of the wellhead members before any energization takes place. When energizing ring 30 is inserted into seal slot 19, the legs 15 deflect slightly. Only a minimal axial force is needed to insert the energizing ring 30 into the seal slot 19. The energizing ring 30 thus does not significantly expand legs 15 but rather form a solid reacting member and causes more radial force to be applied to seal bands 17 located on the outer portions of the legs 15. The deformation of the legs 15 is elastic as the force on them does not exceed their yield strength.

The radial force applied by the energizing ring 30 to the lower yield strength metal bands 17 causes them to deform outward against the surfaces of, for example, the casing hanger 11 and tubing hanger 13, causing localized yielding in the bands 17. Extensive material yielding of the bands 17 thus occurs during energization. The lower yield strength metal bands 17 are soft and malleable enough to flow into defects and degradations on the surfaces of the casing hanger 11 and tubing hanger 13. This improves the metal-to-metal seal with the bore of the casing hanger 11 and the outer surface of the tubing hanger 13 when set.

In the event of bulk seal 32 failure, the U-shaped seal 14 is self-energizing and when pressurized is capable of sealing and filling against damaged annular surfaces of wellhead members with the low yield metal 17. The slot 19 formed by the legs 15 of the U-shaped seals 14 may allow pressure to act on the inner sides of the legs 15, pushing the legs 15 outward against the outer and inner wellhead members 11, 13.

The axial loads required to push the seal assembly 10 into its annular space between the wellhead members 11, 13 are minimal as only a small amount of radial squeeze, i.e. interference fit, is needed to maintain a sealing contact at low pressure.

Figure 3:
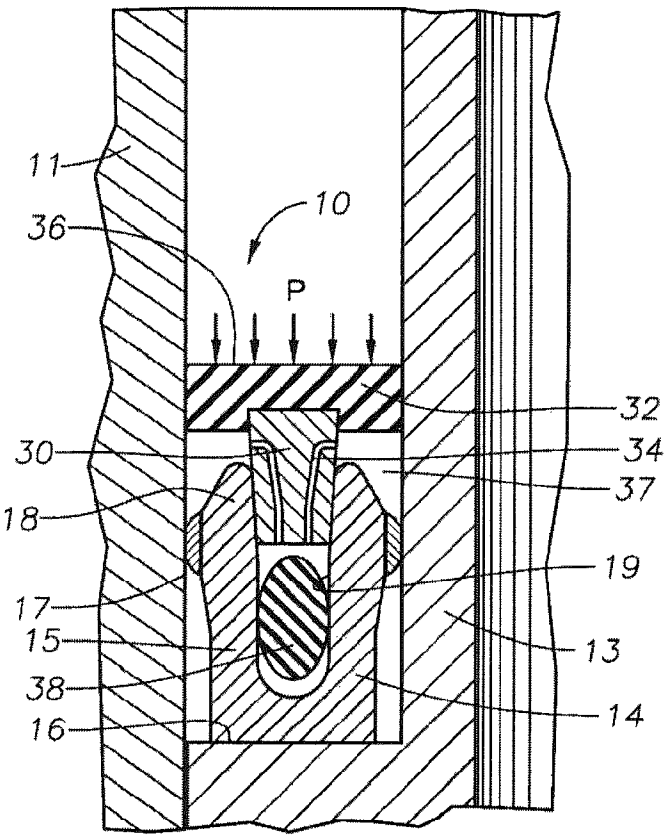
FIG. 3 is a sectional view of the seal assembly with a compressible element, in accordance with an embodiment of the invention.

In another embodiment illustrated in FIG. 3, the seal assembly 10 may further comprise a compressible element 38 fitted into the slot 19 of the U-shaped seal 14. The compressible element 38 shrinks in volume as fluid pressure is applied to it during setting operations, preventing hydraulic lock. In this example, the energizing ring 30 may also have vents 34 as in FIGS. 1 and 2 to aid in the prevention of hydraulic lock.

Figure 4:
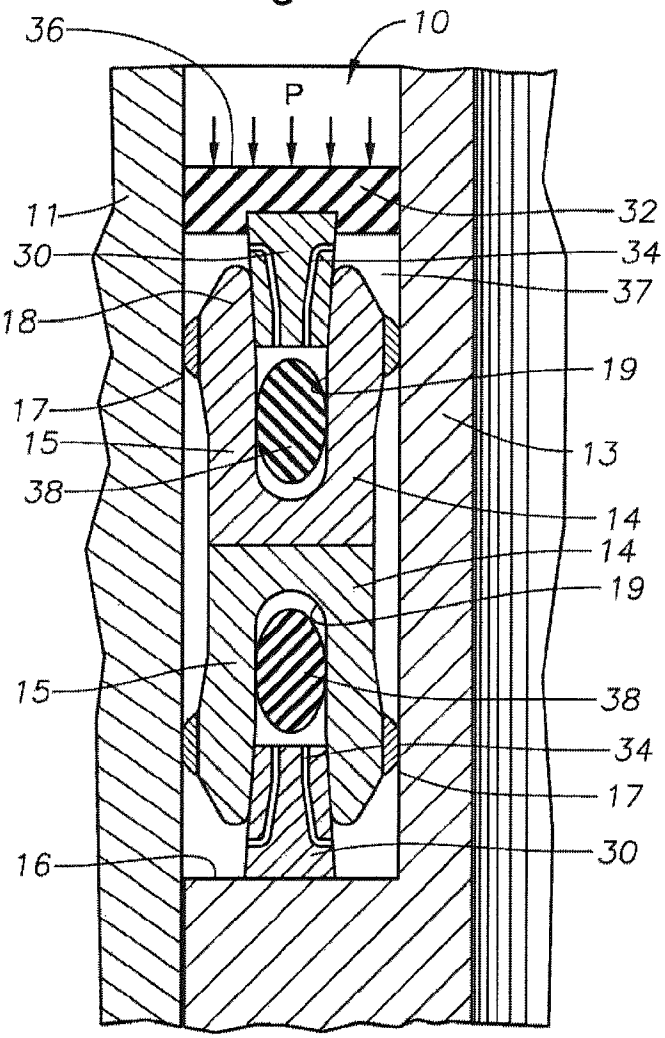
FIG. 4 is a sectional view of a seal assembly with seals in both directions, in accordance with an embodiment of the invention.

In yet another embodiment illustrated in FIG. 4, the seal assembly 10 may comprise two U-shaped seals 14 mounted back to back to allow sealing in two directions. In this embodiment, the annulus is pressurized on one side, preferably in the primary direction, of the seal assembly 10 during setting operations. The pressurization applies a force on the bulk seal 34 to force the energizing rings 30 into the seal pockets 19 of each U-shaped seal 14. In the same way as explained for FIGS. 1 and 2, the legs 15 of each U-shaped seal 14 are forced outward against the surfaces of the wellhead housing 11 and casing hanger 13, causing localized yielding in the low yield metal bands 17 on the outer portion of the legs 15 to deform against the surfaces of the wellhead members to fill any defects. In this example, the U seals are bidirectional such that the back to back arrangement provides bidirectional sealing (from above and below). Although compressible element 38 is shown in this embodiment, the compressible element may be omitted. However, location of the compressible elements 38 within the pockets 19 is preferred to prevent the potential for hydraulic lock. Vents 34 formed on the energizing ring 30 further aid in preventing hydraulic lock within the sealed cavity 37, where generated pressure may cause fluid to bypass seal bands 17.

While the invention has been shown in only one of its forms, it should be apparent to those skilled in the art that it is not so limited but is susceptible to various changes without departing from the scope of the invention.

What is claimed is:

1. A wellhead assembly, comprising:

an outer wellhead member having an inner surface that defines a bore;

an inner wellhead member having an external surface located in the bore, defining a wellhead annulus within the bore;

an annular metal seal member located in the wellhead annulus having an inner annular seal leg and an outer annular seal leg, the seal legs defining an annular slot between them, the annular slot having side walls and a run-in radial width, the annular metal seal member having a base on its lower end adapted to abut a shoulder defined in the wellhead annulus;

an energizing ring located in the wellhead annulus above the annular metal seal member, the energizing ring having an annular wall portion having radial thickness larger than the run-in radial width of the annular slot, carried in a run-in position with a lower end engaging an upper end of the annular slot;

an elastomeric bulk seal located in the wellhead annulus above and in contact with the energizing ring, the elastomeric bulk seal in sealing engagement between the bore of the outer wellhead member and the external surface of the inner wellhead member, the elastomeric bulk seal forming a pressure barrier which defines a pressure chamber in the wellhead annulus above the elastomeric bulk seal such that increasing fluid pressure in the area of the wellhead annulus above the bulk seal causes the bulk seal to move axially toward the annular metal seal member, forcing the energizing ring into the annular slot formed by the seal legs, the energizing ring exerting radial forces on the seal legs to seal the seal legs against the inner and outer wellhead the members, defining a set position, and wherein friction between the energizing ring and the seal legs retains the seal legs in the set position; and a compressible element located within the annular slot formed by the seal legs of the annular metal seal member, the compressible element substantially spaced from the energizing ring when the energizing ring is in the annular slot to maintain the seal legs in the set position.

2. The assembly according to claim 1, wherein the seal assembly further comprises:

an outer seal band coupled to an outer radial surface of the outer annular seal leg of the annular metal seal member operable to form a sealing surface against the bore of the outer wellhead member when in the set position; and an inner seal band coupled to an inner radial surface of the inner annular seal leg of the annular metal seal member operable to form a sealing surface against the external surface of the inner wellhead member when in the set position.

3. The assembly according to claim 2, wherein the inner and outer seal bands coupled to the inner and outer annular seal legs of the annular metal seal member are of a softer metal than the metal of the annular metal seal member.

4. The assembly according to claim 1, wherein the annular slot has tapered surfaces defined on the side walls of the annular slot, and the energizing ring has tapered surfaces defined on the annular wall portion of the energizing ring that mate with the tapered surfaces of the annular slot.

5. The assembly according to claim 1, further comprising a vent port extending through the energizing ring to vent trapped fluid in the annular slot as the energizing ring moves into the annular slot.

6. The assembly according to claim 1, wherein the seal legs of the annular metal seal member form a U-shape.

7. The assembly according to claim 1, wherein the bulk seal is joined to the energizing ring.

8. The assembly according to claim 1, wherein the movement of the inner and outer annular seal legs to the set position is elastic and does not exceed a yield strength of the metal of the metal seal member.

9. The assembly according to claim 1, wherein the compressible element is elastomeric.

10. A seal assembly, comprising:

an annular metal seal member having an inner annular seal leg and an outer annular seal leg, the seal legs defining an annular slot between them, the annular slot having side walls and a run-in radial width;

an energizing ring carried in a run-in position with a lower end engaging an upper end of the annular slot, the energizing ring having an annular wall portion having radial thickness larger than the run-in radial width of the annular slot;

an elastomeric bulk seal mounted to the energizing ring for movement therewith, the elastomeric bulk seal having an inner diameter smaller than an inner diameter of the annular metal seal member and an outer diameter larger than an outer diameter of the annular metal seal member for forming a pressure barrier between inner and outer wellhead members above the energizing ring, such that increasing the pressure above the bulk seal causes the bulk seal to move axially toward the annular metal seal member, forcing the energizing ring into the annular slot so that the seal legs are deflected outward defining a set position and wherein friction between the energizing ring and seal legs retains the seal in the set position; and a compressible element located within the annular slot formed by the seal legs of the annular metal seal member, the compressible element substantially spaced from the energizing ring when the energizing ring is in the annular slot to deflect the seal legs to the set position.

11. The assembly according to claim 10, further comprising a vent port extending through the energizing ring to vent trapped fluid in the annular slot as the energizing ring moves into the annular slot.

12. The assembly according to claim 10, wherein the movement of the inner and outer annular seal legs to the set position is elastic and does not exceed a yield strength of the metal of the metal seal assembly.

13. The assembly according to claim 10, wherein the compressible element is elastomeric.

14. The assembly according to claim 10, wherein the seal assembly further comprises:

an outer seal band coupled to an outer radial surface of the outer annular seal leg of the annular metal seal member operable to form a sealing surface against the bore of the outer wellhead member when in the set position; and an inner seal band coupled to an inner radial surface of the inner annular seal leg of the annular metal seal member operable to form a sealing surface against the external surface of the inner wellhead member when in the set position;

wherein the inner and outer seal bands coupled to the seal legs of the annular metal seal member are of a softer metal than the metal of the metal seal member.

15. A method of installing a wellhead assembly, comprising:

installing an outer wellhead member having an inner surface that defines a bore;

installing an inner wellhead member having an external surface, the inner surface of the outer wellhead member and the external surface of the inner wellhead member defining a wellhead annulus within the bore;

installing a metal seal assembly, the metal seal assembly comprising:

an annular metal seal member having an inner annular seal leg and an outer annular seal leg, the seal legs defining an annular slot between them; and an energizing ring at an upper end of the annular slot formed by the seal legs, the energizing ring having a radial thickness larger than a run-in radial width of the annular slot; and a compressible element located within the annular slot formed by the seal legs of the annular metal seal member;

installing an elastomeric bulk seal into the wellhead annulus distal to the annular metal seal member in contact with the energizing ring, the elastomeric bulk seal in sealing engagement between the bore of the outer wellhead member and the external surface of the inner wellhead member, the elastomeric bulk seal forming a pressure barrier which defines a pressure chamber in the wellhead annulus above the elastomeric bulk seal; and applying hydraulic pressure to the bulk seal, forcing the energizing ring into the annular slot and exerting radial forces on the seal legs to seal against the inner and outer wellhead members, defining a set position wherein the compressible element is substantially spaced from the energizing ring; then relieving the pressure on the bulk seal so that friction between the surfaces of the energizing ring and the seal legs retains the seal in the set position.

16. The method according to claim 15, wherein the metal seal assembly further comprises:

an outer seal band coupled to an outer radial surface of the outer annular seal leg of the annular metal seal member operable to form a sealing surface against the bore of the outer wellhead member when in the set position;

an inner seal band coupled to an inner radial surface of the inner annular seal leg of the annular metal seal member operable to form a sealing surface against the external surface of the inner wellhead member when in the set position; and wherein the inner and outer seal bands are of a softer metal than the metal of the annular metal seal member.

17. The method according to claim 15, further comprising withdrawing the bulk seal and energizing ring to allow the seal legs of the annular metal seal member to relax back to an initial position to thereby allow retrieval of the annular metal seal member.

18. The method according to claim 15, wherein a vent port extends through the energizing ring to vent trapped fluid in the annular slot as the energizing ring moves into the annular slot.

* * * * *